US008172737B1

(12) United States Patent
Nihlman et al.

(10) Patent No.: US 8,172,737 B1
(45) Date of Patent: May 8, 2012

(54) BACK HANDSPRING TRAINING DEVICE

(75) Inventors: Johan Nihlman, Tyreso (SE); James Surgent, Westfield, NJ (US); David Surgent, Westfield, NJ (US)

(73) Assignee: International Gymnastics Innovations LLC, Westfield, NJ (US)

( * ) Notice: Subject to any disclaimer, the term of this patent is extended or adjusted under 35 U.S.C. 154(b) by 0 days.

(21) Appl. No.: 12/967,542

(22) Filed: Dec. 14, 2010

(51) Int. Cl.
*A63B 21/00* (2006.01)

(52) U.S. Cl. ..... 482/144; 482/143; 482/100; 482/907; 606/240

(58) Field of Classification Search ..... 482/144, 482/130, 142
See application file for complete search history.

(56) References Cited

U.S. PATENT DOCUMENTS 4,210,322 A 7/1980 Pritchard
4,961,574 A 10/1990 Lew
4,976,623 A 12/1990 Owsley
5,217,487 A * 6/1993 Engel et al. ..... 606/240
6,971,977 B1 12/2005 Chen
7,033,307 B2 4/2006 Van Straaten
7,097,590 B2 8/2006 Canali
7,118,517 B1 10/2006 Hale
7,255,666 B2 8/2007 Cardenas
7,563,217 B2 7/2009 Endelman
7,942,795 B2 * 5/2011 Harris ..... 482/142
2007/0287599 A1 12/2007 Chartrand

* cited by examiner

*Primary Examiner* — Jerome w Donnelly
(74) *Attorney, Agent, or Firm* — Lerner, David, Littenberg, Krumholz & Mentlik, LLP

(57) ABSTRACT

A gymnastics training apparatus includes a back support rotatably connected to a frame and adapted to support a gymnast during a back handspring. The apparatus includes a guide connected to the frame and adapted to be impacted by the back support as the back support rotates about the frame in engagement with the gymnast. The guide is dimensioned such that, when the back support impacts the guide, the rotational axis of the back support is shifted and the rotation of the back support is accelerated. This acceleration causes the back support to exert pressure against the gymnast and to assist the gymnast in creating a snapdown to safely and correctly practice a back handspring without the assistance of a coach.

21 Claims, 11 Drawing Sheets

32'
34'

32'
34'
In focus
The angle "α" opens twice as fast as "β", due to the guide.

32'
34'

32'
34'

BACK HANDSPRING TRAINING DEVICE

BACKGROUND OF THE INVENTION

The present invention relates generally to gymnastics training devices and methods, and more particularly to an apparatus and method for teaching a gymnast to perform a back handspring safely and with the correct form in the absence of a coach.

Various gymnastics training devices and methods are well-known and have been commonly utilized for years. However, typical training methods for teaching a gymnast the correct form for a back handspring require a coach to manually support the gymnast throughout the back handspring motion in order to assist the gymnast in completing the motion and maintaining the correct body position at each stage of the back handspring. However, such methods rely on the strength of the coach, and can be significantly taxing on the muscles of the coach over time. Additionally, these methods do not allow a gymnast to practice a back handspring safely and correctly in the absence of a coach.

Therefore, apparatus for supporting a gymnast while practicing a back handspring are sometimes used. Conventional apparatus for practicing a back handspring typically include a device that supports the gymnast during a rotation from an upright position to a partially inverted position, after which the gymnast attempts to complete the back handspring by separating from the apparatus and rotating to an upright position. However, these apparatus tend to encourage the gymnast to complete the back handspring by simply allowing the legs to naturally fall over the torso, which is known as a "pike down." Thus, such training apparatus and related methods do not teach the correct form for completing a back handspring, in that they do not teach the gymnast to accelerate his or her hips and/or legs during the later part of the back handspring rotation, which is known as a "snapdown." Completing the rotation with a snapdown is considered the proper form for performing a back handspring.

A snapdown generally includes accelerating the legs and hips of the gymnast about the torso of the gymnast, to propel the gymnast to rotate from a substantially inverted position to a substantially upright position to complete the back handspring, while preserving the horizontal and rotational momentum gained by the gymnast during the back handspring rotation. Therefore, this momentum may be used to continue into another gymnastics maneuver, such as another back handspring, a back flip, or other similar maneuver.

Existing apparatus and methods only teach the gymnast to complete the rotation in a pike down, which directs the horizontal and rotational momentum gained during the first back handspring toward the floor as the legs fall over, so the momentum gained during the first back handspring is effectively lost. Thus, these devices and methods are ineffective at teaching the correct form for a back handspring, as they do not teach the gymnast to create a snapdown.

While using a training apparatus to practice a back handspring can be helpful to a gymnast, there is a recognized need for a training apparatus which helps the gymnast to complete the back handspring with the correct form without requiring a coach to support the athlete during the maneuver and assisting the gymnast in creating a snapdown and using the momentum gained from the back handspring to continue into a series of gymnastic maneuvers.

BRIEF SUMMARY OF THE INVENTION

The present invention relates generally to gymnastics training devices and methods, and more particularly to an apparatus and method for teaching a gymnast to perform a back handspring safely and with the correct form in the absence of a coach.

In accordance with one aspect of the invention, a gymnastics training apparatus includes a frame, a guide mounted on the frame and a back support. The back support is rotatably connected to the frame at a pivot point. The back support is adapted to support a gymnast while performing a back handspring. When the back support is in a first position, the back support faces a first direction in which a gymnast can be against the back support on one side of the pivot point ready for a back handspring. The back support is adapted to rotate about the pivot point to a second position to engage the guide while in engagement with the gymnast. In the second position, the back support faces a second direction and is at least partially inverted.

In accordance with one embodiment, the guide at least partially supports the back support when the back support is in the second position.

In accordance with another embodiment, at least one shoulder support is connected to the back support by an adjustable connection. The shoulder support is removably connected to the back support. The adjustable connection is adapted to adjust one or more of the length, width, and angle of the shoulder support.

In accordance with another embodiment, the back support includes a cradle. The cradle is adapted to be engaged by the gymnast during the back handspring. In accordance with another embodiment, at least part of the cradle includes a curved surface. The curved surface is adapted to be engaged by the gymnast during the back handspring. In one alternative, the cradle frame comprises a top board and a base board. The top board is mounted to the cradle. The base board is movably connected to the top board by a movable joint. In another alternative, the movable joint comprises at least one hinge. In a further alternative, a tether connects the top board to the base board.

In accordance with another embodiment, the back support is rotatably connected to the frame.

In accordance with another embodiment, the gymnastics training apparatus also includes a footboard. In one alternative, the footboard includes a springboard.

In accordance with another embodiment, a propulsion device is connected to the back support.

In accordance with another aspect of the invention, a gymnastics training apparatus comprises a frame, a cradle frame, and a cradle. The cradle frame includes a base board which is pivotably coupled to the frame for rotation about a first axis. The cradle frame also includes a top board which is pivotably coupled to the base board for rotation about a second axis. The second axis is spaced from the first axis. The cradle is attached to the top board for rotation with the top board. When the cradle is in a first position relative to the base board, the cradle rotates about the first axis. When the cradle is in a second position relative to the base board, the cradle rotates about said second axis.

In accordance with one embodiment, the second axis is spaced in a horizontal direction from the first axis.

In accordance with another embodiment, when the cradle moves from the first position to the second position, the top board rotates about the second axis and separates from the base board. In one alternative, the cradle is removably connected to the top board. A movable joint pivotably couples the top board to the base board. In another alternative, the cradle frame further includes a tether. The tether is connected to the top board at a location that is spaced from the movable joint.

The tether is also connected to the base board at a location that is spaced from the movable joint.

In accordance with another embodiment, the apparatus also includes a base that supports the frame.

In accordance with another embodiment, the apparatus also includes a footboard. The footboard is adjustably connected to the base. In one alternative, the footboard comprises a springboard.

In accordance with a further aspect of the invention, a gymnastics training apparatus includes a frame, a back support, and a guide. The back support is rotatably connected to the frame at a pivot point. The back support is adapted to support a gymnast while performing a back handspring. The back support includes a cradle adapted to be engaged by the gymnast during the back handspring. The back support also includes a top board and a base board, which are pivotably connected to one another by a movable joint. The top board is connected to the cradle for rotation with the cradle. The guide includes a first vertex spaced in a horizontal direction from the pivot point. The back support has a first position on a first side of the pivot point and a second position on a second side of the pivot point. When the back support is in the first position, the back support faces a first direction. A rotational axis is formed at the pivot point. The back support is adapted to rotate about the rotational axis from the first position to the second position. When the back support is in the second position, the back support faces a second direction and the top board engages the first vertex. When the top board engages the first vertex, the rotational axis of the top board is shifted to the movable joint.

In accordance with one embodiment, the guide further includes a second vertex spaced in a horizontal direction from the first vertex. The rotation of the top board about the movable joint causes the top board to engage the second vertex. When the top board engages the movable joint, the cradle is caused to rotationally accelerate while the cradle is in engagement with the gymnast. In one alternative, the rotation of the top board about the movable joint causes the top board and the cradle to rotationally accelerate. The rotational acceleration causes the top board to separate from the base board while the cradle is in engagement with the gymnast. In another alternative, when the top board and the cradle rotationally accelerate, about the movable joint, the cradle propels the gymnast to rotationally accelerate. The rotational acceleration of the gymnast causes the gymnast to create a snapdown.

A method according to another aspect of the invention includes using the gymnastics training apparatus to train a gymnast. The gymnastics training apparatus includes a frame, a cradle frame, and a cradle. The cradle frame includes a base board pivotably coupled to the frame and a top board pivotably coupled to the base board. The base board is adapted to rotate about the frame. The top board is adapted to rotate with respect to the base board. The cradle is connected to the top board to allow the cradle to rotate with the top board. The method according to one embodiment begins by positioning the gymnast against the cradle. While in engagement with the cradle, the gymnast propels himself or herself to rotate about the frame while maintaining engagement with the cradle. The cradle and the gymnast thus rotate about a first axis to bring the cradle frame into engagement with the guide. By virtue of the rotational momentum of the cradle and the gymnast, when the cradle frame engages the guide the cradle rotates about a second axis spaced from the first axis while the gymnast engages the cradle. The top board is joined to the cradle for rotation with the cradle, and therefore also rotates about the second axis. Accordingly, the top board rotates with respect to the base board, which continues to rotate about the first axis. The cradle frame thus opens, whereby the top board and the base board separate from one another. The gymnast rotates about the second axis while in engagement with the cradle to a substantially inverted position while the base board rotates further about the first axis. Rotation about the second axis causes the gymnast to rotationally accelerate, enabling the gymnast to initiate a snapdown. The cradle is subsequently restrained from rotating further about the second axis. The gymnast then rotates about a third axis spaced from the first and second axes, separating from the cradle and creating a snapdown to complete the back handspring rotation. The method can be executed without the need for a coach to support the gymnast during the back handspring rotation, allowing the gymnast to practice the proper form for a back handspring and to create a snapdown safely and effectively, even in the absence of a coach.

BRIEF DESCRIPTION OF THE DRAWINGS

The present invention will be better understood on reading the following detailed description of non-limiting embodiments thereof, and on examining the accompanying drawings, in which.

DETAILED DESCRIPTION

In describing the preferred embodiments of the subject illustrated and to be described with respect to the drawings, specific terminology will be used for the sake of clarity. However, the invention is not intended to be limited to any specific terms used herein, and it is to be understood that each specific term includes all technical equivalents that operate in a similar manner to accomplish a similar purpose.

Figure 1:
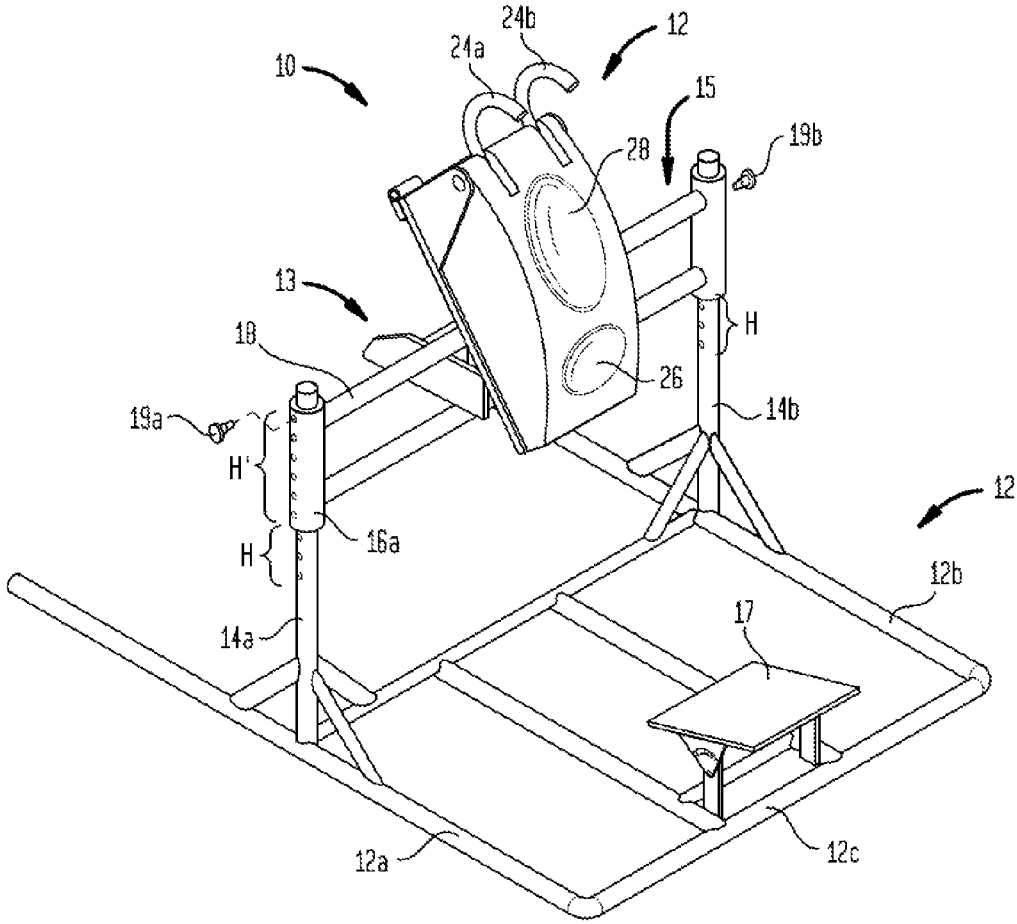
FIG. 1 is a perspective view of the present apparatus in an initial rest position.

Referring to FIG. 1, there is shown a back handspring training apparatus 10 in accordance with one embodiment of the present invention. Apparatus 10 is adapted to be used by a gymnast G to practice a back handspring. In the embodiment shown, apparatus 10 includes a base 12, a guide 13, a set of vertical supports 14*a*, 14*b*, a footboard 17, and a frame 15. While the embodiment shown includes two vertical supports

14*a*, 14*b*, in other embodiments, apparatus 10 may include more than two vertical supports. Frame 15 in turn includes a set of adjustable sleeves 16*a*, 16*b* and a pivot bar 18 extending therebetween. While the embodiment shown includes two adjustable sleeves 16*a*, 16*b*, in other embodiments, apparatus 10 may include more than two adjustable sleeves. Each of these structures is described in further detail below.

Figure 2A:
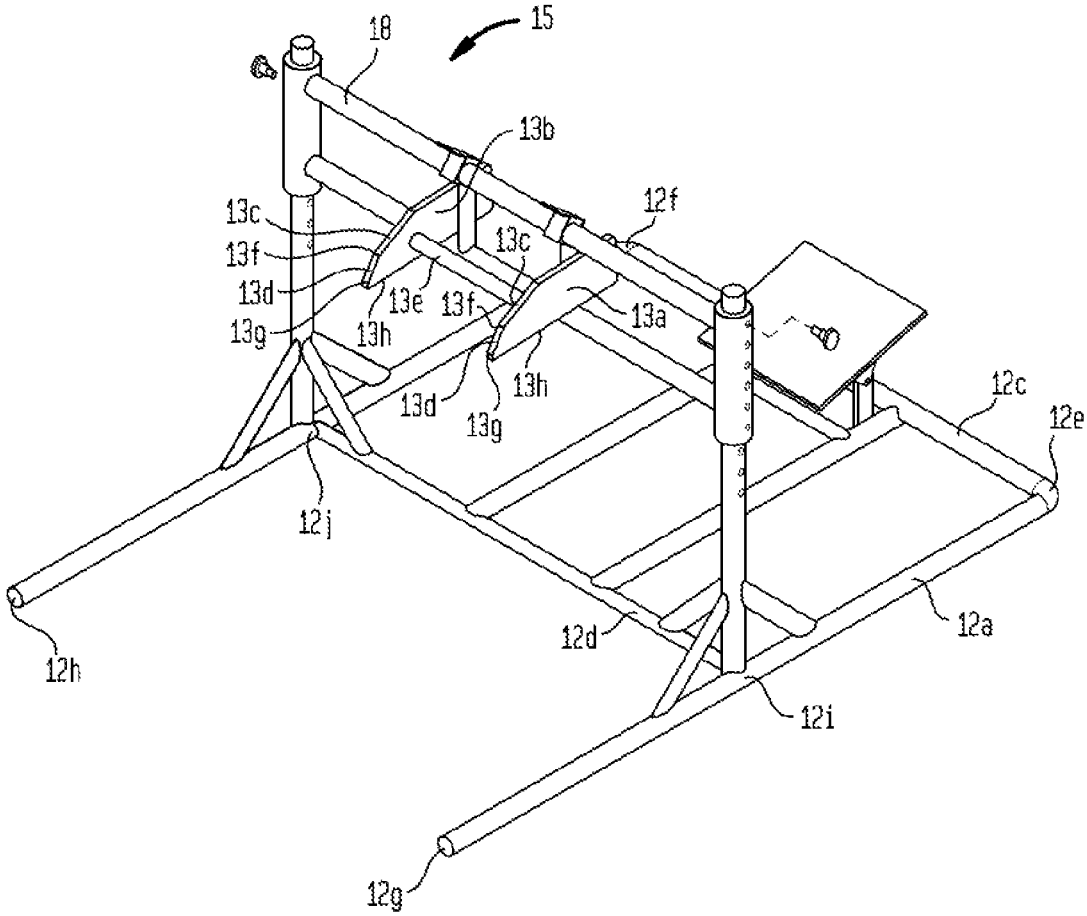
FIG. 2A is a perspective view of the present apparatus with the back support removed.

As best shown in FIG. 2A, base 12 includes four base bars 12*a*-12*d*. Base bars 12*a*, 12*b* extend substantially parallel to one another, while base bar 12*c* extends between one end 12*e* of base bar 12*a* and one end 12*f* of base bar 12*b* substantially perpendicularly to each of base bars 12*a* and 12*b*. In the embodiment shown, base bar 12*d* extends substantially parallel to base bar 12*c* between an intermediate point 12*i* of base bar 12*a* and a corresponding intermediate point 12*j* of base bar 12*b*. In the embodiment shown, the intermediate points 12*i*, 12*j* at which base bar 12*d* connects to base bars 12*a* and 12*b*, respectively, generally coincide with the locations at which vertical supports 14*a*, 14*b* are connected to base bars 12*a*, 12*b*, respectively. In other embodiments, base 12 may include more or fewer base bars, and the base bars may be joined to one another at other than approximately right angles. In an alternative embodiment, detachable wheels (not shown) may be connected to base 12 to allow apparatus 10 to be transported or repositioned more easily.

As best shown in FIG. 2A, base bars 12*a*, 12*b* also include opposite ends 12*g*, 12*h*, respectively. Ends 12*g*, 12*h* are spaced from one another and are not connected to one another, so as to accommodate a landing mat (not shown) therebetween. Such a landing mat advantageously provides a soft medium on which gymnast G may land, for both increased safety and comfort. The landing mat may be made of foam or any other suitable material, and may be coated by a coating material, for example, vinyl.

In a preferred embodiment, base bars 12*a*-12*d* are entirely or partly constructed from a suitable metal, such as steel, though one skilled in the art will appreciate that other types of appropriate materials such as wood or plastics could also be used for any or all of these features. Furthermore, in some embodiments, one or more of base bars 12*a*-12*d* may be entirely or partly covered by a foam material for increased safety of gymnast G. In such embodiments, the foam material may be entirely or partly coated by a coating material, such as vinyl or any other suitable coating material.

As best shown in FIGS. 1-2A, vertical supports 14*a*, 14*b* extend substantially vertically from and substantially orthogonal to base bars 12*a*, 12*b*, respectively. In a preferred embodiment, vertical supports 14*a*, 14*b* are generally cylindrically shaped, though other shapes may be used. Vertical supports 14*a*, 14*b* are preferably constructed from a suitable metal, such as steel, though one skilled in the art will appreciate that other appropriate materials, such as wood or plastics, could also be used for all or part of vertical supports 14*a*, 14*b*.

Preferably, vertical supports 14*a*, 14*b* are sized and shaped such that adjustable sleeves 16*a*, 16*b* can be slidably fit over vertical supports 14*a*, 14*b*, respectively. Accordingly, adjustable sleeves 16*a*, 16*b* each include an elongated internal cavity adapted and dimensioned to slidably receive vertical supports 14*a*, 14*b*, respectively. In a preferred embodiment, vertical supports 14*a*, 14*b* each include a plurality of holes H spaced from one another along the length of vertical supports 14*a*, 14*b*. Each of holes H extends through all or part of the diameter of vertical supports 14*a*, 14*b*. In the embodiment shown, adjustable sleeves 16*a*, 16*b* each include at least one hole H' positioned to be aligned with one of holes H in each of vertical supports 14*a*, 14*b*. Accordingly, a pair of support pins 19*a*, 19*b* are adapted and dimensioned to be inserted through one of holes H' and one of holes H to support adjustable sleeves 16*a*, 16*b* on vertical supports 14*a*, 14*b*, respectively, to support the weight of frame 15, guide 13, back support 20, and gymnast G throughout the back handspring movement. By virtue of holes H in vertical supports 14*a*, 14*b* and hole H' in adjustable sleeves 16*a*, 16*b*, adjustable sleeves 16*a*, 16*b* are adjustably mounted on vertical supports 14*a*, 14*b*.

As best shown in FIG. 1, frame 15 also includes pivot bar 18 extending between adjustable sleeves 16*a*, 16*b* to provide at least one pivot point about which back support 20 and gymnast G rotate during the back handspring rotation, as described below. Thus, by adjusting the height at which adjustable sleeves 16*a*, 16*b* are mounted on vertical supports 14*a*, 14*b*, respectively, the height of pivot bar 18 can be adjusted according to the size and/or skill level of gymnast G. In a preferred embodiment, frame 15, including adjustable sleeves 16*a*, 16*b* and pivot bar 18, is partly or entirely constructed from an appropriate metal, for example, steel; however, one skilled in the art will appreciate that other suitable metals or other materials, such as wood or plastics, may also be used for all or a part of frame 15.

As best shown in FIG. 1, apparatus 10 also includes footboard 17. In the embodiment shown, footboard 17 includes a pedestal attached to base 12 and is preferably made at least partly of a suitable metal, such as steel. However, in other embodiments, other metals or appropriate materials such as plastics, wood, or foam materials may also be used for all or part of footboard 17. In the embodiment shown, footboard 17 includes a plate-like platform. In other embodiments, however, footboard 17 may include a bar instead of, or in addition to, the plate-like platform. Gymnast G may stand on footboard 17 to begin the back handspring at a position elevated from the floor, which positions gymnast G at a desired height to properly engage a back support 20 as described hereinafter. Beginning at this elevated position provides gymnast G with a mechanical advantage, so gymnast G is not required to exert as much force as would be required to initiate the back handspring when standing on the floor. Thus, the desired height of frame 15, and more particularly pivot bar 18, may vary based on the height, strength, and/or skill level of gymnast G. Alternatively, footboard 17 may include a springboard (not shown) mounted thereto in order to provide gymnast G with additional mechanical advantage for beginning the back handspring rotation. In one embodiment, footboard 17 is adjustably connected to base 12, such that the height and/or angle at which footboard 17 is positioned can each be adjusted based on the preference, height, and/or skill level of gymnast G. In some embodiments, footboard 17 may also be removed from base 12, such as for a more advanced and/or taller gymnast.

Figure 2B:
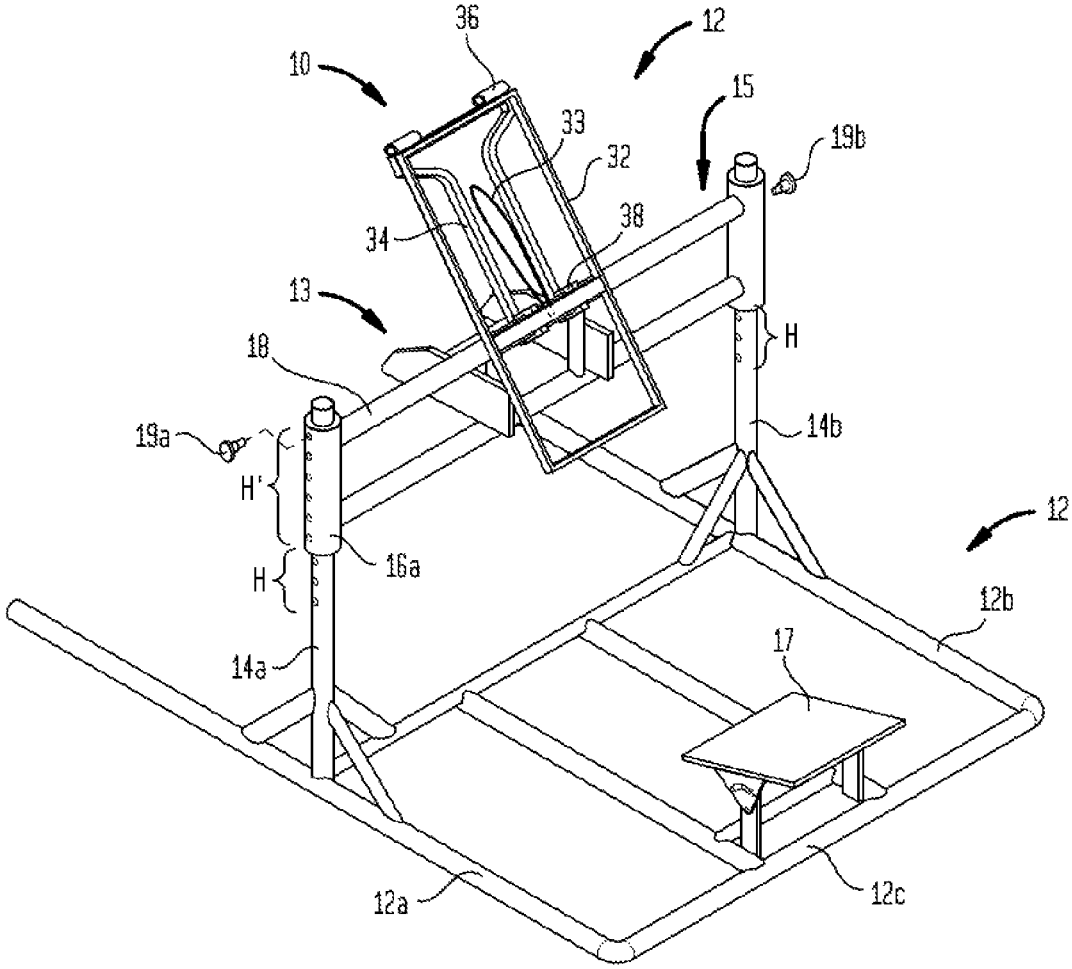
FIG. 2B is a perspective view of the present apparatus with the cradle removed from the back support.

Back support 20 is rotatably connected to frame 15 and includes a cradle 22 and a set of shoulder supports 24*a*, 24*b*. Back support 20 also includes a cradle frame 30 connected to cradle 22. In a preferred embodiment, cradle frame 30 is removably mounted to cradle 22, such that cradle 22 can be disconnected from cradle frame 30 to facilitate transportation and storage of apparatus 10. As best shown in FIG. 2B, cradle frame 30 in turn includes a top board 32 and a base board 34 connected to one another by a movable joint 36. Movable joint 36 may include one or more hinges or other similar devices, and allows top board 32 and base board 34 to rotate away from one another as described hereinafter. A tether 33 is connected to both top board 32 and base board 34. Tether 33 limits the degree to which top board 32 and base board 34 may rotate away from one another via movable joint 36. As best shown in FIG. 2B, at least a portion of base board 34 is narrower in width and shorter in length than top board 32. As described hereinafter, this difference in width allows base board 34 to pass within guide 13 and to contact a crossbar 13*e* of guide 13 while top board 32 engages guide 13, causing cradle frame 30 to open via movable joint 36. In the embodiment shown in FIG. 2B, top board 32 and base board 34 each include a frame formed by a plurality of substantially linear structural members. However, in other embodiments, top board 32 and/or base board 34 may be formed by a substantially rigid, continuous board.

As best shown in FIG. 2B, cradle frame 30 also includes a rotatable connector 38 which rotatably connects back support 20 to frame 15. In the embodiment shown, rotatable connector 38 rotatably connects base board 34 to pivot bar 18. Rotatable connector 38 may include one or more bearings connected to cradle frame 30 and journaled around pivot bar 18 to allow back support 20 to rotate about pivot bar 18 with reduced friction. Alternatively, rotatable connector 38 may include one or more hinged latches which close around pivot bar 18 to allow back support 20 to rotate about pivot bar 18. Rotatable connector 38 may include a releasable connection which allows back support 20 to be removed from apparatus 10.

Figure 6:
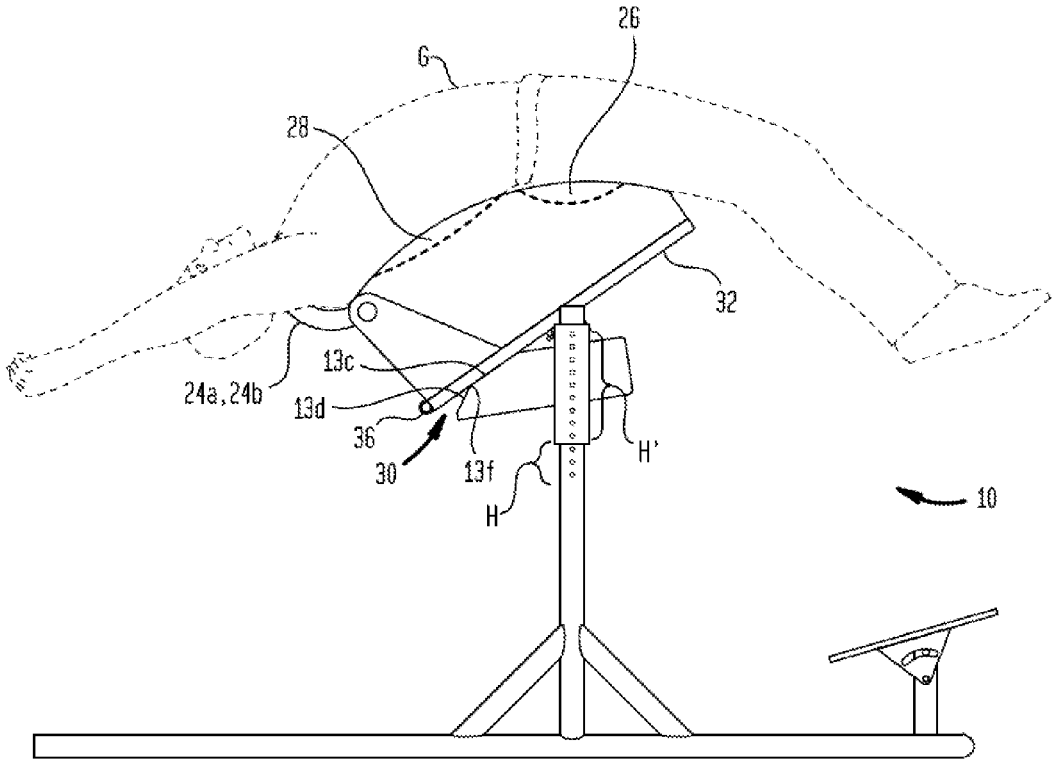
FIG. 6 is a side view of the present apparatus engaged by a gymnast in a subsequent intermediate position during the back handspring movement.

As best shown in FIGS. 1 and 6, cradle 22 is preferably curved to form an arcuate surface for engagement by gymnast G. By engaging cradle 22, the back of gymnast G is maintained in a substantially concave arc, consistently with the correct form for executing a back handspring. Furthermore, as gymnast G rotates about pivot bar 18 during the back handspring motion, cradle 22 supports gymnast G at a spaced distance from pivot bar 18. This spaced relationship simulates the rotational trajectory at which gymnast G would perform a back handspring without using apparatus 10. Therefore, the design of cradle 22 assists gymnast G in practicing the correct form for a back handspring. Additionally, as gymnast G rotates about pivot bar 18 while engaging cradle 22, back support 20 engages guide 13, as discussed in further detail below. Cradle 22 transfers the force of the impact between guide 13 and back support 20 to gymnast G to redirect the rotation of gymnast G and back support 20 by horizontally shifting the rotational axis of gymnast G and back support 20. As will be discussed in further detail below, this impact and the horizontal shifting of the rotational axis of gymnast G and back support 20 ultimately causes gymnast G to initiate a snapdown, by which the rotation of gymnast G is accelerated as gymnast G completes the back handspring.

As best shown in FIG. 1, cradle 22 preferably includes a hip recess 26 and a back recess 28. As shown in FIGS. 4-7, hip recess 26 is adapted and dimensioned to accommodate the lower back and/or hips of gymnast G, which provides more reliable engagement between gymnast G and cradle 22 throughout the back handspring rotation, as well as increased comfort to gymnast G. Back recess 28 is adapted and dimensioned to accommodate all or a portion of the back of gymnast G. Back recess 28 provides more reliable engagement between gymnast G and cradle 22 and greater comfort to gymnast G throughout the back handspring rotation while supporting gymnast G in the correct form for a back handspring. In other embodiments, hip recess 26 and/or back recess 28 may be omitted.

In a preferred embodiment, cradle 22 is constructed from a foam material. Alternatively, all or part of cradle 22 may be constructed from a suitable metal, plastic, or wood material in combination with a foam layer. In any of these embodiments, the foam may be coated by vinyl or any other similar coating material.

Figure 3:
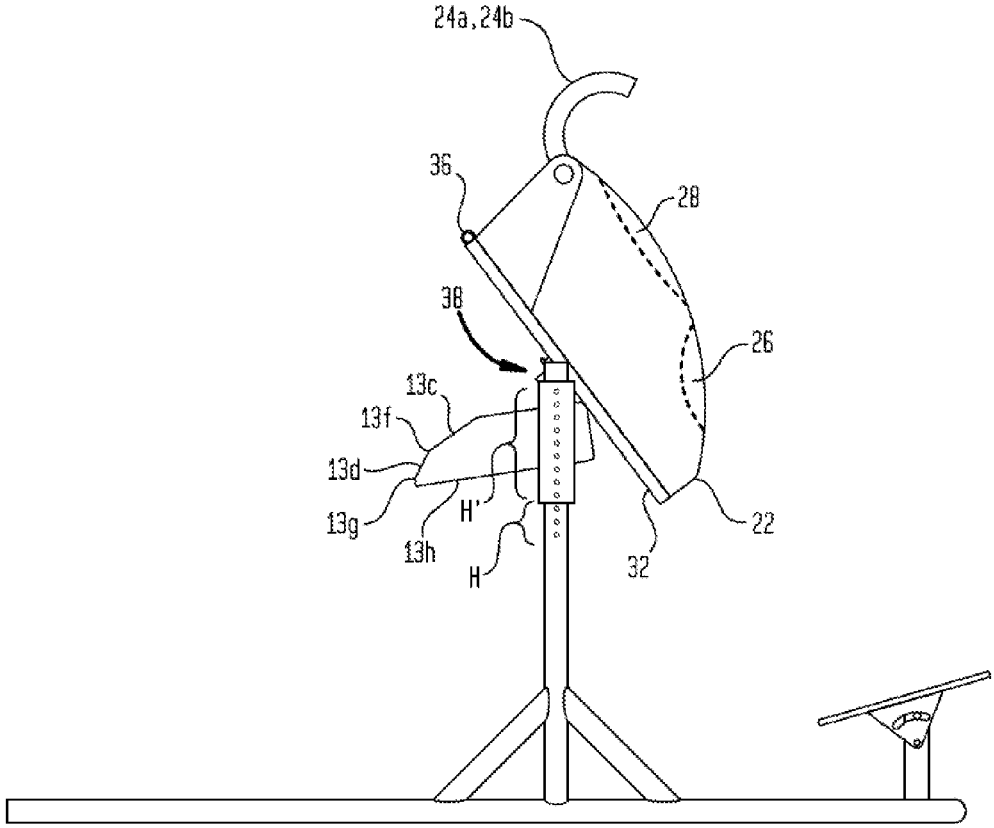
FIG. 3 is a side view of the present apparatus in the position in FIG. 1.
Figure 4:
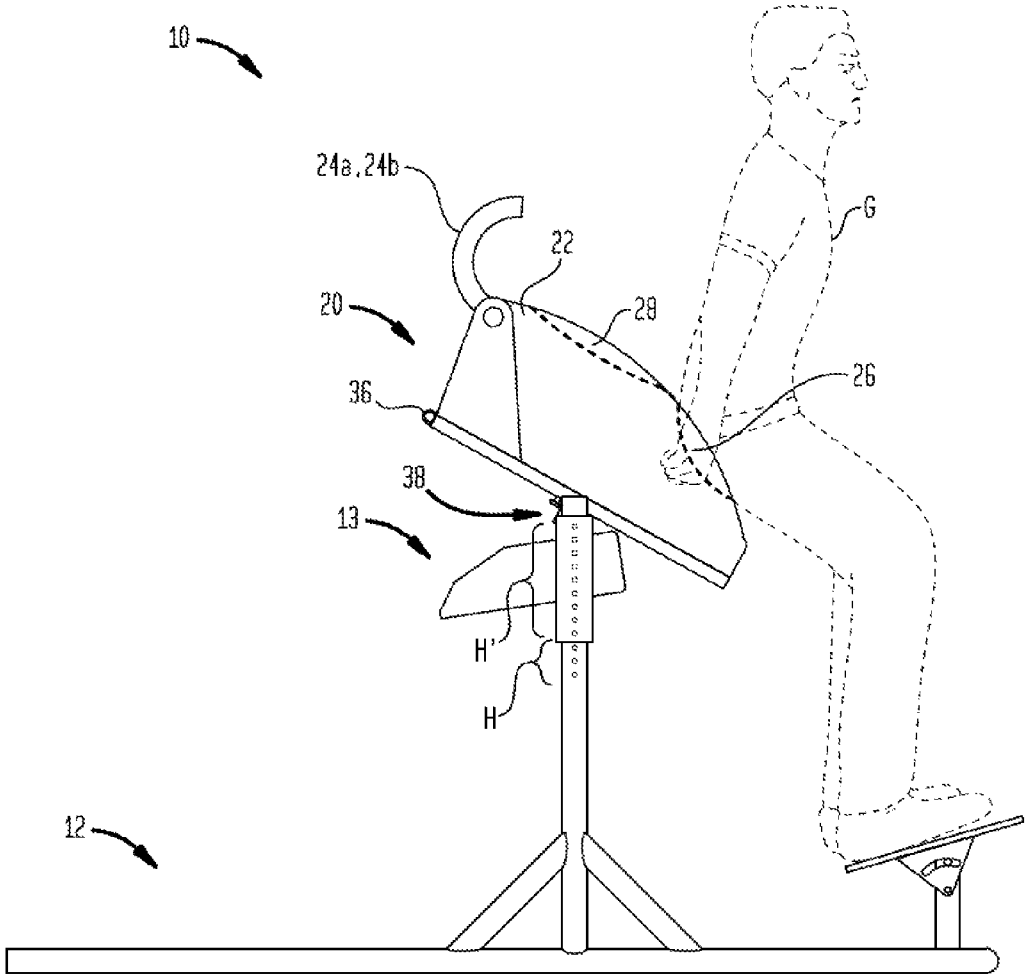
FIG. 4 is a side view of the present apparatus engaged by a gymnast in the starting position.

As best shown in FIGS. 1, 3, and 4, cradle 22 preferably includes a set of adjustable and removable connections to accommodate a set of shoulder supports 24*a*, 24*b*. In the embodiment shown in FIG. 1, the adjustable and removable connections each include a recess into which a lower part of shoulder supports 24*a*, 24*b* may be inserted. Within each recess, the connections may include one or more slots into which the lower parts of shoulder supports 24*a*, 24*b* are removably fit. The one or more slots within each recess may be arranged at different angles from one another to provide multiple options for the angles at which shoulder supports 24*a*, 24*b* are arranged. Thus, the angle at which shoulder supports 24*a*, 24*b* extend may be adjusted based on the size and/or preference of the gymnast, and/or the desired difficulty level.

Furthermore, the connections in cradle 22 for shoulder supports 24*a*, 24*b* may be adapted to allow adjustment of the exposed lengths of shoulder supports 24*a*, 24*b*. For example, shoulder supports 24*a*, 24*b* may include a threaded lower end dimensioned to engage one or more threaded apertures within the recesses. Alternatively, shoulder supports 24*a*, 24*b* may include a plurality of ratchet-type teeth dimensioned to engage one or more similarly dimensioned pawls within the recesses. In yet another embodiment, one or more apertures dimensioned to accommodate locking pins (not shown) may extend through at least part of the diameter of the lower ends of shoulder supports 24*a*, 24*b*. The adjustable connections may include one or more apertures similarly dimensioned to engage with the locking pins (not shown) and removably lock shoulder supports 24*a*, 24*b* into a selected position.

In one embodiment, cradle 22 includes a plurality of adjustable and removable connections arranged along the width of cradle 22. Therefore, the width at which shoulder supports 24*a*, 24*b* are arranged may also be adjusted based on the size and/or preference of the gymnast, and/or to adjust the level of difficulty.

Additionally, the connections may also include recesses dimensioned to accommodate the exposed ends of shoulder supports 24*a*, 24*b*, such that shoulder supports 24*a*, 24*b* may be partly or completely concealed within cradle 22 or removed from cradle 22 to more closely simulate a back handspring at the highest level of difficulty.

In the embodiment shown, shoulder supports 24*a*, 24*b* each include a curved, hook-shaped bar adapted to engage the shoulders of gymnast G. However, in other embodiments, shoulder supports 24*a*, 24*b* may have a different curvature. Alternatively, shoulder supports 24*a*, 24*b* may each include a substantially linearly shaped bar, or a plurality of bars connected to one another at acute, obtuse, or right angles.

In a preferred embodiment, shoulder supports 24 are made of a suitable metal, for example, steel, all or part of which is coated by a layer of foam for increased comfort to the gymnast. Alternatively, other types of metals, woods, or plastics may also be used for all or a part of shoulder supports 24*a*, 24*b*. Shoulder supports 24*a*, 24*b* may also be made partly or completely of a suitable foam material. In any of these embodiments, part or all of the foam may be coated by a coating material such as vinyl.

Back support 20 also includes cradle frame 30 mounted to cradle 22. Preferably, cradle frame 30 is removably mounted to cradle 22, such that cradle frame 30 and cradle 22 may be easily separated for transportation and storage of apparatus 10. Cradle frame 30 includes top board 32 and base board 34, each of which is preferably constructed from a suitable metal, for example, steel. However, one skilled in the art will appreciate that other suitable metals, woods, or plastics may also be used for part or all of cradle frame 30, top board 32, and/or base board 34. During the back handspring rotation, cradle frame 30 engages guide 13. At least a part of base board 34 is narrower in width than top board 32, which allows base board 34 to fit between a pair of side panels 13*a*, 13*b* of guide 13 while top board 32 engages side panels 13*a*, 13*b*, as described hereinafter. Top board 32 is connected to base board 34 by movable joint 36, which allows top board 32 to separate from base board 34 during part of the back handspring motion, as described below. In the embodiment shown, movable joint 36 includes a hinge. However, in other embodiments, movable joint 36 may include other similar mechanisms or means to perform a similar function.

As best shown in FIG. 2B, cradle frame 30 also includes rotatable connector 38, which rotatably connects cradle frame 30 to frame 15, thus enabling back support 20 to rotate about pivot bar 18 during the back handspring motion. Rotatable connector 38 may include any suitable connector such as one or more bearings, a hinged latch, or any other similar rotatable connector. In a preferred embodiment, rotatable connector 38 includes a detachable connection, such that back support 20 may be disconnected from frame 15 and interchanged with another back support, for example, one of a different size for a gymnast of a different height and/or skill level.

Tether 33 connects top board 32 to base board 34 to limit the degree to which cradle frame 30 can open. Tether 33 thus prevents top board 32 and base board 34 from separating from one another beyond a prescribed maximum degree. Therefore, back support 20 only rotates to a prescribed position, which is reached before gymnast G completes the back handspring rotation, causing gymnast G to separate from back support 20 to complete the back handspring maneuver. Tether 33 preferably includes a metal cable, but may also be constructed of a rope, suitable plastic, or other appropriate material. Although tether 33 is connected to top board 32 and base board 34 in the embodiment shown, in other embodiments, tether 33 may alternatively or additionally be connected to one or more other parts of apparatus 10.

Guide 13 is mounted to frame 15 and includes a pair of side panels 13*a*, 13*b* connected by crossbar 13*e* extending therebetween. In a preferred embodiment, guide 13 is made of a suitable metal, such as steel. However, other suitable metals, woods, or plastics may also be used for all or part of side panels 13*a*, 13*b* and/or crossbar 13*e*. As best shown in FIG. 2A, a first contact region 13*c* is formed on the top of side panels 13*a*, 13*b*. In a preferred embodiment, a second contact region 13*d* is also formed by side panels 13*a*, 13*b* adjacent to first contact region 13*c*. First contact region 13*c* preferably includes a sloped surface formed on the top of side panels 13*a*, 13*b*. Preferably, first and second contact regions 13*c*, 13*d* are each substantially planar. A first vertex 13*f* is formed at a joint between first contact region 13*c* and second contact region 13*d*. Similarly, a second vertex 13*g* is formed at a joint between second contact region 13*d* and an underside 13*h* of guide 13. As described in further detail below, during the back handspring rotation of gymnast G and back support 20 about pivot bar 18, cradle frame 30 sequentially engages first contact region 13*c*, first vertex 13*f*, second contact region 13*d*, and second vertex 13*g*, causing cradle 22 and top board 32 to rotate about movable joint 36, thereby opening cradle frame 30 via movable joint 36, to assist gymnast G in completing the back handspring progression. Guide 13 is thus adapted and dimensioned to facilitate this progression and to assist gymnast G in creating a snapdown to complete the back handspring.

In the embodiment shown, guide 13 includes two contact regions 13*c*, 13*d*. However, in another embodiment, guide 13 may include one contact region corresponding to one intermediate position of gymnast G and back support 20 during the back handspring motion. In yet another embodiment, guide 13 may include one or more additional contact regions, and therefore additional vertices, corresponding to one or more additional intermediate positions of gymnast G and back support 20 during the back handspring motion.

FIG. 3 shows a side view of apparatus 10 in an initial resting position. In this position, back support 20 is on one side of frame 15, ready for engagement by gymnast G.

FIG. 4 depicts apparatus 10 in a starting position in which gymnast G stands in a ready position while a part or all of the back of gymnast G engages cradle 22 of back support 20. Preferably, in this position, the lower back and/or hips of gymnast G engage hip recess 26 of cradle 22 for more reliable engagement between gymnast G and cradle 22 and increased comfort for gymnast G throughout the back handspring rotation.

Depending on the gymnast's size and/or level of skill, gymnast G may stand on footboard 17 for additional mechanical advantage, while a more advanced and/or taller gymnast could stand directly on the floor. From the starting position, gymnast G initiates a back handspring by jumping backward against cradle 22 to rotate his or her body and back support 20 about pivot bar 18.

As shown in FIGS. 5-8, gymnast G rotates through several intermediate positions throughout the back handspring while engaging back support 20, more particularly, cradle 22.

Figure 5:
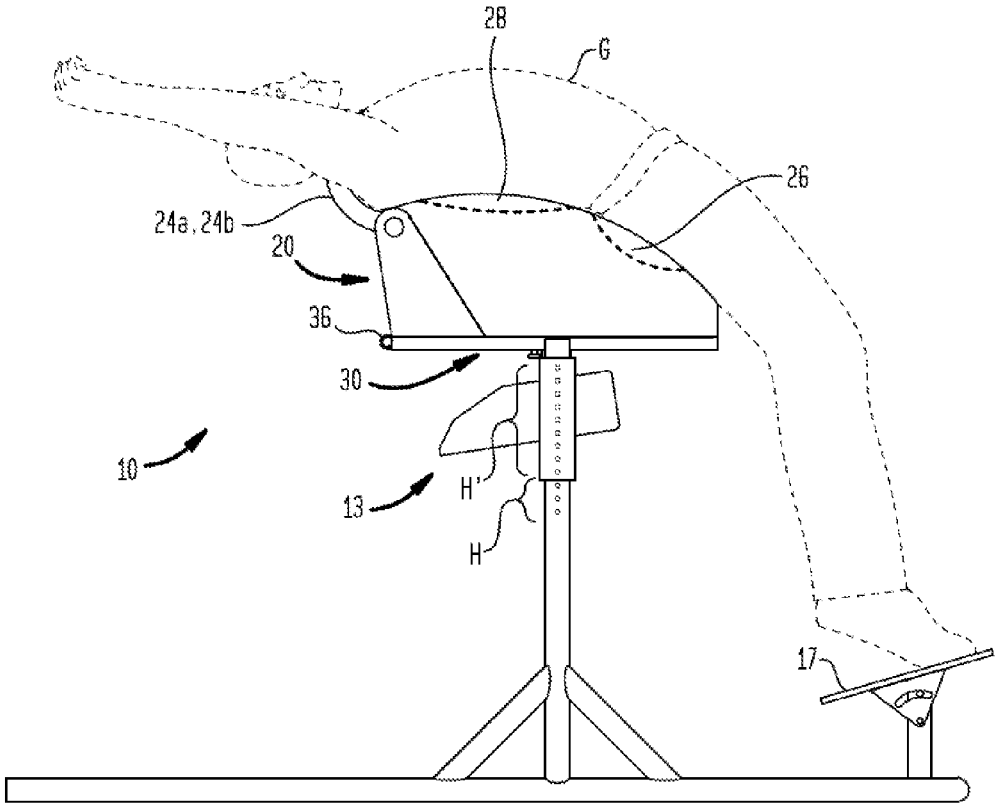
FIG. 5 is a side view of the present apparatus engaged by a gymnast in an intermediate position during the back handspring movement.

After jumping backward from the starting position, gymnast G rotates together with back support 20 about pivot bar 18 to a substantially horizontal intermediate position, as shown in FIG. 5. The curved design of cradle 22 encourages gymnast G to maintain his or her back in an arc throughout the rotation, consistently with the correct form for a back handspring.

FIG. 6 shows gymnast G in a subsequent intermediate position during the back handspring progression. In this subsequent intermediate position, gymnast G has rotated together with back support 20 about pivot bar 18 to a partially inverted position, thereby bringing cradle frame 30 into engagement with guide 13. Specifically, top board 32 of cradle frame 30 engages first contact region 13*c* formed on the top of side panels 13*a*, 13*b* while base board 34 simultaneously passes between side panels 13*a*, 13*b* of guide 13. In this partially inverted position, shoulder supports 24 may support part or all of the weight of gymnast G, thereby preventing gymnast G from inadvertently separating from back support 20 too early in the back handspring progression or moving away from the desired position against cradle 22. Accordingly, shoulder supports 24 provide enhanced safety for gymnast G and assist gymnast G in practicing the proper form for a back handspring.

The impact between top board 32 and first contact region 13*c* causes top board 32, together with cradle 22 and gymnast G, to begin rotating about movable joint 36. At the same time, base board 34 continues to rotate about pivot bar 18 and passes between side panels 13*a*, 13*b*, such that movable joint 36 also continues to rotate about pivot bar 18. The center of gravity of gymnast G together with cradle 22 and top board 32 rotates about movable joint 36 while movable joint 36 continues to rotate about pivot bar 18, causing cradle frame 30 to open via movable joint 36, and creating an angle of separation between top board 32 and base board 34. The rotation of movable joint 36 about pivot bar 18 while gymnast G, cradle 22, and top board 32 rotate together about movable joint 36 causes gymnast G, together with cradle 22 and top board 32, to rotationally accelerate about movable joint 36 without the application of any external forces.

Figure 7:
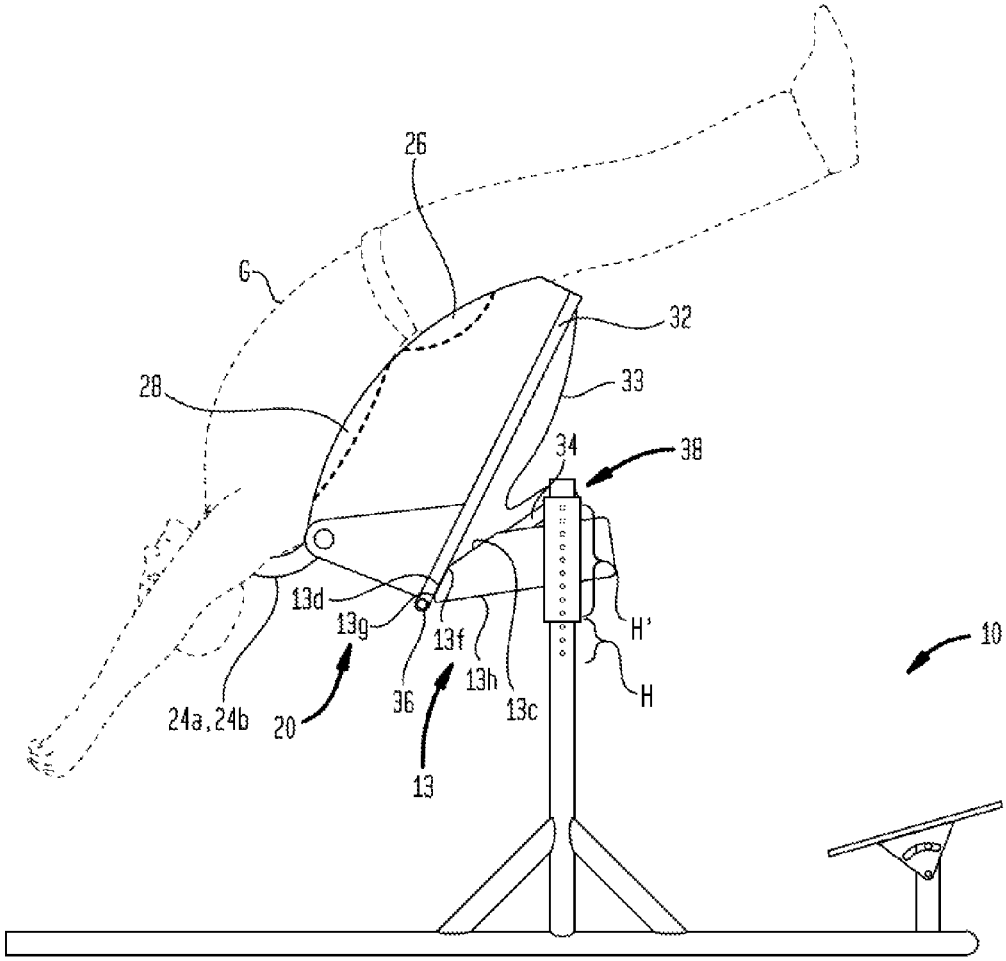
FIG. 7 is a side view of the present apparatus engaged by a gymnast in another subsequent intermediate position during the back handspring movement.

The rotation of gymnast G, cradle 22, and top board 32 together about movable joint 36 brings top board 32 into engagement with second contact region 13*d*, as shown in FIG. 7. At the same time, base board 34 continues to rotate about pivot bar 18, such that movable joint 36 continues to rotate about pivot bar 18 and base board 34 passes further between side panels 13*a*, 13*b*. The center of gravity of gymnast G, together with cradle 22 and top board 32, simultaneously continues to rotate about movable joint 36, forcing gymnast G, together with cradle 22 and top board 32, to rotationally accelerate again about movable joint 36 without the application of any external forces. Therefore, gymnast G, cradle 22, and top board 32 rotate together about movable joint 36 with considerably greater rotational velocity than the velocity with which movable joint 36 rotates about pivot bar 18. In a preferred embodiment, guide 13 is adapted and dimensioned such that the rotational velocity of gymnast G, cradle 22, and top board 32 about movable joint 36 over the interval of time during which top board 32 engages second vertex 13*g* is approximately two times the rotational velocity with which movable joint 36 rotates about pivot bar 18 over the same interval of time.

As an illustrative example, FIGS. 10A-10D show an embodiment in which guide 13 is dimensioned such that, while top board 32 engages second vertex 13*g*, gymnast G, cradle 22, and top board 32 rotate together about movable joint 36 with a rotational velocity that is approximately two times the rotational velocity with which movable joint 36 simultaneously rotates about pivot bar 18. In FIGS. 10A-10D, reference numeral 32' designates a rotational orientation of top board 32, and reference numeral 34' designates a rotational orientation of base board 34. Reference character a designates an angle of separation between rotational orientation 34' and a vertical reference V about pivot bar 18. Reference character b designates an angle of separation between rotational orientation 32' and rotational orientation 34' about movable joint 36. In the illustrative embodiment shown, guide 13 is adapted and dimensioned such that, over the interval of time during which top board 32 engages second vertex 13*g*, angle of separation b increases approximately two degrees for every one degree that angle of separation a increases.

Figures 10A, 10B, 10C, 10D:
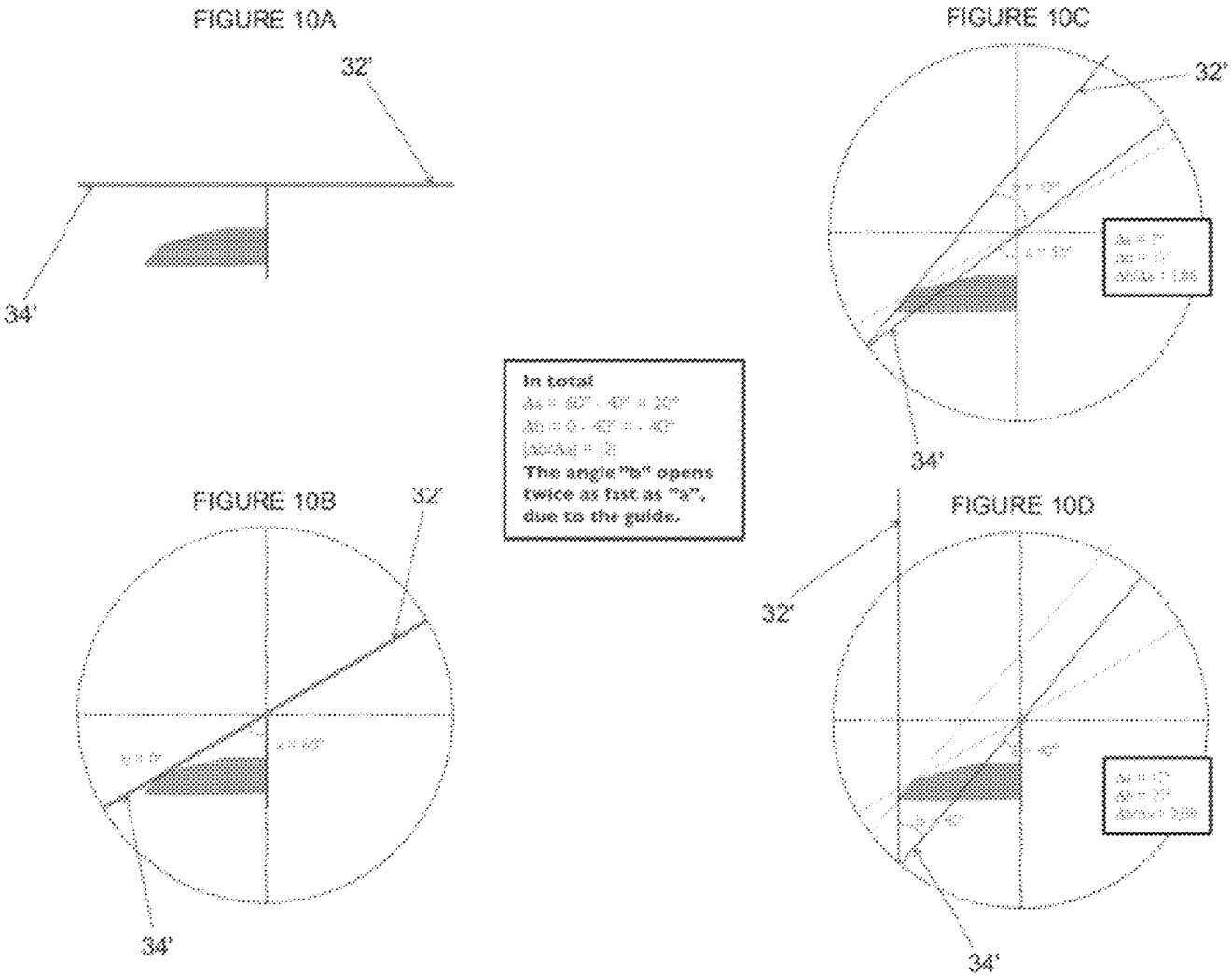
FIGS. 10A-10D show the rotational orientation of the apparatus throughout the back handspring progression in an illustrative embodiment.

In FIG. 10A, rotational orientations 32' and 34' are substantially horizontal, substantially consistently with the position of gymnast G and back support 20 depicted in FIG. 5.

FIG. 10B shows rotational orientations 32' and 34' in a partially inverted position, substantially consistently with the position of gymnast G and back support 20 depicted in FIG. 6. In the position shown in FIG. 10B, rotational orientations 32' and 34' are such that top board 32 engages first vertex 13*f*, and cradle frame 30 is about to begin opening via movable joint 36.

In FIG. 10C, rotational orientations 32' and 34' are arranged in a subsequent inverted position, substantially consistently with the position of gymnast G, cradle 22, and top board 32 shown in FIG. 7. Rotational orientation 34' is such that base board 34 passes partially between side panels 13*a*, 13*b*, while at the same time rotational orientation 32' is such that top board 32 impacts second contact surface 13*d* and begins to engage second vertex 13*g*. Accordingly, cradle frame 30 opens via movable joint 36, increasing angle of separation b between top board 32 and base board 34 while simultaneously changing angle of separation a about pivot bar 18 between rotational orientation 34' and vertical reference V. In this embodiment, guide 13 is dimensioned such that the magnitude of the change in angle of separation b about movable joint 36 between the positions shown in FIGS. 10B and 10C is significantly greater than the magnitude of the change in angle of separation a about pivot bar 18 between these two positions.

Figure 8:
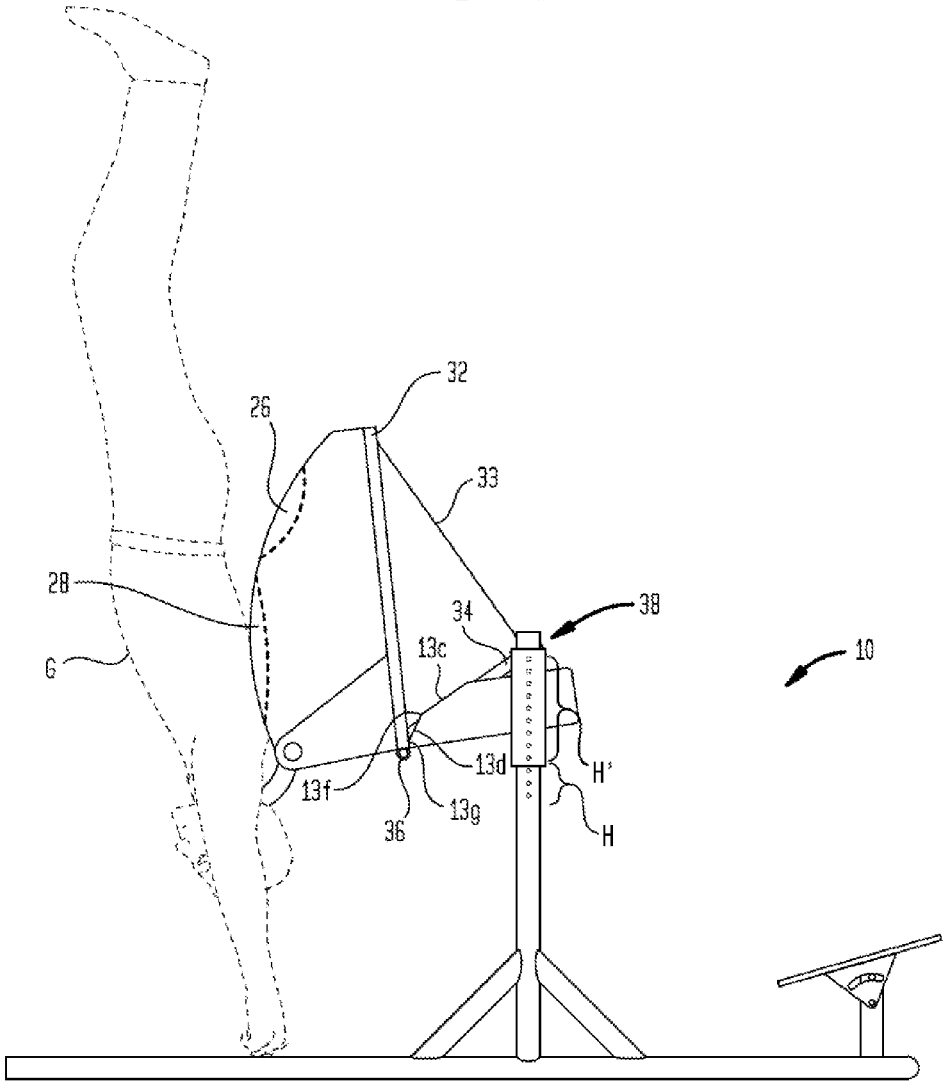
FIG. 8 is a side view of the present apparatus partially engaged by a gymnast in a subsequent substantially inverted position during the back handspring movement.

In FIG. 10D, rotational orientations 32' and 34' are arranged substantially consistently with the substantially inverted position shown in FIG. 8. Rotational orientation 34' is such that base board 34 passes further between side panels 13*a*, 13*b*, while at the same time rotational orientation 32' is such that top board 32 engages second vertex 13*g*. Therefore, cradle frame 30 continues to open about movable joint 36 throughout the interval of time during which top board 32 engages second vertex 13*g*, further increasing angle of separation a about pivot bar 18 while simultaneously and more significantly changing angle of separation b. In this embodiment, guide 13 is dimensioned such that the magnitude of the change in angle of separation b is approximately two times the magnitude of the change in angle of separation a between the partially inverted position shown in FIG. 10B and the substantially inverted position shown in FIG. 10D. Accordingly, in this embodiment, at the end of the interval of time during which top board 32 engages second vertex 13*g*, gymnast G, cradle 22, and top board 32 rotate together about movable joint 36 with approximately two times the rotational velocity with which movable joint 36 simultaneously rotates about pivot bar 18.

Gymnast G, cradle 22, and top board 32 rotate together about movable joint 36 to a substantially inverted position. As gymnast G rotates toward this position while in engagement with cradle 22, base board 34 passes further between side panels 13*a*, 13*b* to contact crossbar 13*e* while cradle frame 30 continues to open via movable joint 36, increasing angle of separation b between top board 32 and base board 34, and causing tether 33 to extend and tighten therebetween. The tightening of tether 33 prevents top board 32, and therefore back support 20, from rotating any further with respect to base board 34. However, by virtue of the rotational momentum accrued by gymnast G throughout the back handspring progression, gymnast G separates from cradle 22 and continues to rotate about shoulder supports 24 past this position to a fully inverted position and subsequently to a substantially erect position to complete the back handspring progression.

FIG. 8 shows gymnast G, together with cradle 22 and top board 32, in the fully inverted position, with base board 34 resting against crossbar 13*e* to prevent base board 34 from rotating further with respect to pivot bar 18. In this position, top board 32 is fully separated from base board 34 via movable joint 36 with tether 33 tightly extended therebetween. Tether 33 connects to each of top board 32 and base board 34 at locations which are spaced from movable joint 36. When tether 33 is fully extended, as shown in FIG. 8, top board 32, and therefore cradle 22, is thereby prevented from rotating further with respect to base board 34.

As gymnast G, cradle 22, and top board 32 approach the substantially inverted position shown in FIG. 8, the rotational acceleration of cradle 22 and top board 32 together about movable joint 36 causes cradle 22 to press forcefully against the upper back and/or shoulders of gymnast G to impart additional horizontal and rotational momentum to gymnast G, assisting gymnast G in creating a snapdown to safely and correctly complete the back handspring. This additional momentum, in combination with the momentum accrued by gymnast G throughout the back handspring rotation, causes gymnast G to rotate about shoulder supports 24*a*, 24*b* while shoulder supports 24*a*, 24*b* support substantially all of the weight of gymnast G. Thus, the rotational axis of gymnast G is shifted substantially horizontally again to shoulder supports 24*a*, 24*b*, causing gymnast G to rotate about shoulder supports 24*a*, 24*b* with even greater rotational velocity than the velocity with which gymnast G rotated about movable joint 36. As a result, the hips and legs of gymnast G are propelled to quickly rotate about shoulder supports 24*a*, 24*b*, and to therefore accelerate in a generally horizontal direction away from apparatus 10, creating a snapdown. Therefore, the present apparatus assists gymnast G in practicing the correct form for a back handspring by initiating a snapdown, rather than simply allowing the hips and legs to naturally fall over the torso in a pike down, which would direct the accrued momentum of gymnast G downwardly.

As gymnast G rotates about shoulder supports 24*a*, 24*b* to the fully inverted position, the hips and legs of gymnast G separate from cradle 22 with increased rotational and horizontal velocity as a result of the momentum gained by gymnast G during the back handspring motion. This acceleration assists gymnast G in initiating a snapdown while completing the back handspring progression. Throughout this rotation, the hips and legs of gymnast G rotate with respect shoulder supports 24*a*, 24*b* and move substantially horizontally away from apparatus 10, consistently with the correct form for performing a back handspring.

Moreover, creating a snapdown allows gymnast G to carry the momentum of the hips and legs through the rotation to safely and effectively complete the back handspring maneuver. Gymnast G can then utilize this accrued momentum to continue directly into a subsequent gymnastic maneuver, such as another back handspring, a back flip, or other similar maneuver. Accordingly, the present invention provides the further advantage of assisting gymnast G to practice executing a series of multiple maneuvers in sequence.

Figure 9:
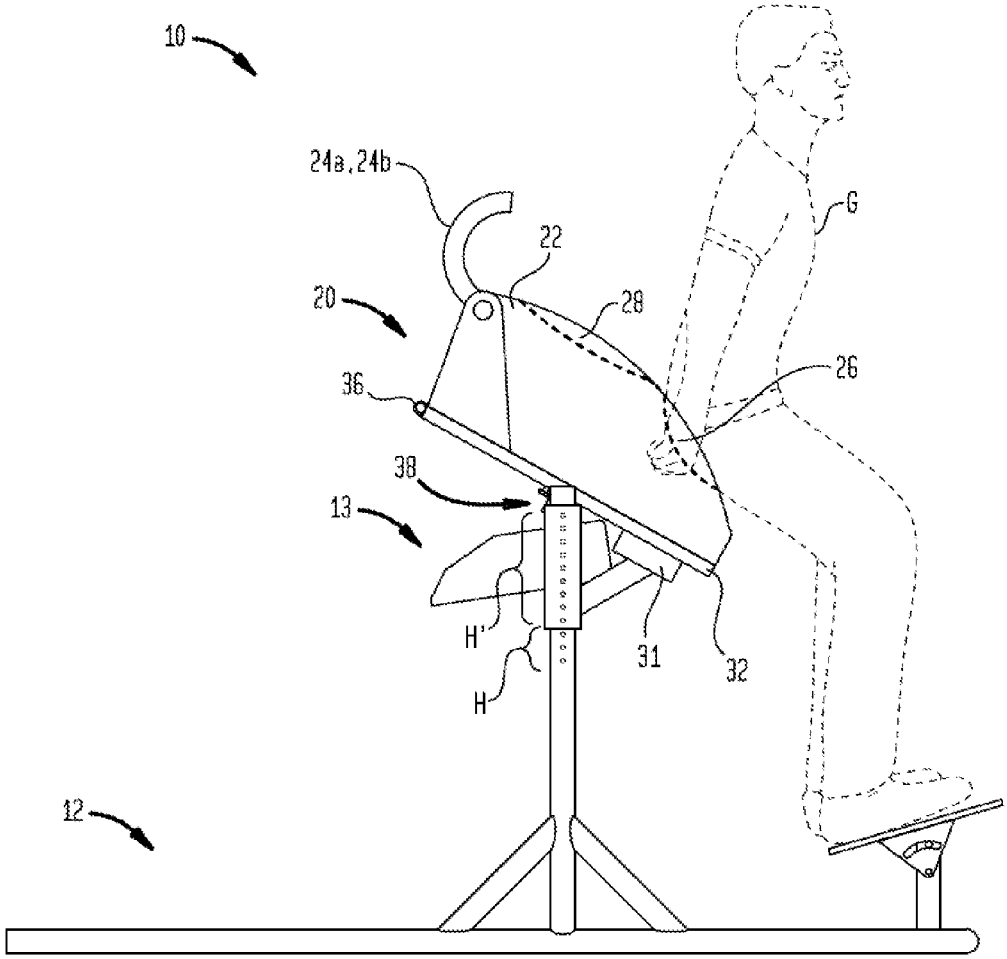
FIG. 9 is a side view of alternative embodiment of the present apparatus.

In the embodiment described above with respect to FIGS. 1-8, gymnast G manually initiates the rotational motion of gymnast G and back support 20 about pivot bar 18. However, FIG. 9 depicts an alternative embodiment in which the rotational motion of back support 20 and gymnast G may be created, either entirely or partially, by a propulsion device 31 mounted on or connected to apparatus 10. In the illustrative embodiment shown in FIG. 9, propulsion device 31 may include an electric motor coupled to back support 20 and/or cradle frame 30. In such an embodiment, the output shaft of the electric motor may be coupled to back support 20 by a power transmission means, such as conventional hydraulics, a gear train, pulleys, or other similar power transmission means.

In the embodiment shown in FIG. 9, propulsion device 31 may alternatively include a spring mechanism for creating the rotational motion of gymnast G and back support 20 about pivot bar 18. For example, the spring mechanism may include one or more springs that are coupled to one or more parts of apparatus 10, for example, back support 20 and/or frame 15. In this embodiment, at least one of the springs is at least partially deformed from its natural position when back support 20 and gymnast G are in the starting position. Therefore, the restoring force provided by the spring mechanism propels back support 20 and gymnast G to rotate about pivot bar 18, thus reducing the force that gymnast G must manually impart to rotate gymnast G and back support 20 about pivot bar 18.

In the embodiment shown in FIG. 9, propulsion device 31 may alternatively include a pneumatic mechanism, for example one or more pistons arranged similarly to the spring mechanism described in the previous embodiment. In this embodiment, the pneumatic mechanism may be connected to one or more parts of apparatus 10, for example back support 20, such that the pneumatic mechanism propels back support 20 and gymnast G to rotate about pivot bar 18, thus reducing the force that gymnast G must manually impart to rotate gymnast G and back support 20 about pivot bar 18.

In another embodiment, cradle frame 30 may include a propulsion device (not shown) connected to top board 32 and base board 34 to facilitate the opening of cradle frame 30 about movable joint 36. In this embodiment, the propulsion device may include, for example, an electric motor, a spring mechanism, or a pneumatic mechanism, or any similar device for performing an analogous function. In this embodiment, the propulsion device is actuated to propel top board 32 and base board 34 away from one another when gymnast G is in a substantially inverted position, such that cradle frame 30 opens via movable joint 36 with accelerated speed. This accelerated opening of cradle frame 30 about movable joint 36 causes cradle 22 to bear against gymnast G, thereby propelling gymnast G to initiate a snapdown to complete the back handspring motion. In this embodiment, guide 13 may include one or more contact surfaces and one or more vertices.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A gymnastics training apparatus, comprising:

a frame;

a guide mounted on the frame; and a back support rotatably connected to the frame at a pivot point and being adapted to support a gymnast while performing a back handspring;

the back support having a first position in which the back support faces a first direction and in which a gymnast can be against the back support on one side of the pivot point ready for a back handspring, the back support being adapted to rotate about the pivot point to a second position to engage the guide while in engagement with the gymnast, wherein in the second position the back support faces a second direction and is at least partially inverted;

wherein the back support includes a cradle adapted to be engaged by the gymnast during the back handspring.

2. The gymnastics training apparatus according to claim 1, wherein the guide at least partially supports the back support in the second position.

3. The gymnastics training apparatus according to claim 1, further comprising at least one shoulder support removably connected to the back support by at least one adjustable connection adapted to adjust at least one of the length, width, and angle of the shoulder support.

4. The gymnastics training apparatus according to claim 1, wherein at least part of the cradle includes a curved surface adapted to be engaged by the gymnast during the back handspring.

5. The gymnastics training apparatus according to claim 4, further comprising a cradle frame, the cradle frame comprising a top board and a base board, the top board being mounted to the cradle, the base board being movably connected to the top board by a movable joint.

6. The gymnastics training apparatus according to claim 5, the top board being connected to the base board by a tether.

7. The gymnastics training apparatus according to claim 1, further comprising a footboard.

8. The gymnastics training apparatus according to claim 1, further comprising a propulsion device connected to the back support.

9. A gymnastics training apparatus, comprising:

a frame, a cradle frame comprising a base board pivotably coupled to said frame for rotation about a first axis, and a top board pivotably coupled to said base board for rotation about a second axis spaced from said first axis, and a cradle attached to said top board for rotation therewith, whereby said cradle when in a first position relative to said base board rotates about said first axis and when in a second position relative to said base board rotates about said second axis.

10. The gymnastics training apparatus according to claim 9, wherein said second axis is spaced in a horizontal direction from said first axis.

11. The gymnastics training apparatus according to claim 9, wherein the top board separates from the base board by rotation about the second axis when said cradle moves from the first position to the second position.

12. The gymnastics training apparatus according to claim 11, wherein the cradle is removably connected to the top board and the top board is pivotably coupled to the base board by a movable joint.

13. The gymnastics training apparatus according to claim 12, the cradle frame further including a tether connected to the top board at a location that is spaced from the movable joint and connected to the base board at a location that is spaced from the movable joint.

14. The gymnastics training apparatus according to claim 9, further comprising a base that supports the frame.

15. A gymnastics training apparatus, comprising:

a frame;

a back support rotatably connected to the frame at a pivot point and being adapted to support a gymnast while performing a back handspring;

the back support including a cradle adapted to be engaged by the gymnast during the back handspring, a top board connected to the cradle for rotation therewith, and a base board pivotably connected to the top board by a movable joint; and a guide including a first vertex spaced in a horizontal direction from the pivot point;

the back support having a first position on a first side of the pivot point, wherein in the first position the back support faces a first direction;

the back support being adapted to rotate about a rotational axis formed at the pivot point to a second position on a second side of the pivot point, wherein in the second position the back support faces a second direction and the top board engages the first vertex of the guide whereby the rotational axis of the top board is shifted to the movable joint.

16. A gymnastics training apparatus according to claim 15, wherein the guide further includes a second vertex spaced in a horizontal direction from the first vertex, wherein the rotation of the top board about the movable joint causes the top board to engage the second vertex, whereby the cradle is caused to rotationally accelerate while in engagement with the gymnast.

17. A gymnastics training apparatus according to claim 16, wherein the rotation of the top board about the movable joint causes the top board and the cradle to rotationally accelerate whereby the top board separates from the base board while the cradle is in engagement with the gymnast.

18. A gymnastics training apparatus according to claim 17, wherein the rotational acceleration of the top board and the cradle about the movable joint while the cradle is in engagement with the gymnast causes the cradle to propel the gymnast to rotationally accelerate and to create a snapdown.

19. A method for training a gymnast, comprising the steps:

positioning the gymnast against a gymnastics training apparatus, the apparatus including a frame, a cradle frame comprising a base board pivotably coupled to said frame for rotation about a first axis, and a top board pivotably coupled to said base board for rotation about a second axis spaced from said first axis, and a cradle attached to said top board for rotation therewith, rotating the gymnast about the first axis while the gymnast engages the cradle;

bringing the cradle frame into engagement with the guide, whereby the cradle rotates about the second axis while the gymnast engages the cradle; and rotating the gymnast about a third axis to bring the gymnast out of engagement with the cradle.

20. A gymnastics training apparatus, comprising:

a frame;

a guide mounted on the frame; and a back support rotatably connected to the frame at a pivot point and being adapted to support a gymnast while performing a back handspring;

the back support having a first position in which the back support faces a first direction and in which a gymnast can be against the back support on one side of the pivot point ready for a back handspring, the back support being adapted to rotate about the pivot point to a second position to engage the guide while in engagement with the gymnast, wherein in the second position the back support faces a second direction and is at least partially inverted;

the gymnastics training apparatus further comprising at least one shoulder support removably connected to the back support by at least one adjustable connection adapted to adjust at least one of the length, width, and angle of the shoulder support.

21. A gymnastics training apparatus, comprising:

a frame;

a guide mounted on the frame; and a back support rotatably connected to the frame at a pivot point and being adapted to support a gymnast while performing a back handspring;

the back support having a first position in which the back support faces a first direction and in which a gymnast can be against the back support on one side of the pivot point ready for a back handspring, the back support being adapted to rotate about the pivot point to a second position to engage the guide while in engagement with the gymnast, wherein in the second position the back support faces a second direction and is at least partially inverted;

the gymnastics training apparatus further comprising a propulsion device connected to the back support.

* * * * *